United States Patent [19]

Vassiliou

[11] Patent Number: 4,684,551

[45] Date of Patent: Aug. 4, 1987

[54] THIXOTROPIC MATERIAL COATING APPARATUS, DISTRIBUTOR DEVICE AND METHOD

[75] Inventor: Eustathios Vassiliou, Newark, Del.

[73] Assignee: E. I. Du Pont de Nemours and Company, Wilmington, Del.

[21] Appl. No.: 826,913

[22] Filed: Feb. 6, 1986

[51] Int. Cl.[4] ..... B05C 3/10; B05D 1/26

[52] U.S. Cl. ..... 427/345; 118/404; 427/434.7; 427/445

[58] Field of Search ..... 427/434.7, 345, 445, 427/430.1; 118/404, 405, 410

[56] References Cited

U.S. PATENT DOCUMENTS

| | | | |
|---|---|---|---|
| 2,647,296 | 8/1953 | Shive | 28/74 |
| 2,647,488 | 8/1953 | Shive | 118/44 |
| 2,953,818 | 9/1960 | Bartron . | |
| 3,020,579 | 2/1962 | O'Connor | 118/410 X |
| 3,139,470 | 6/1964 | Prengle et al. | 264/289 |
| 3,690,294 | 9/1972 | Harper | 118/112 |
| 3,896,764 | 7/1975 | Kindl et al. | 118/404 |
| 4,028,473 | 6/1977 | Conti | 427/434.7 |
| 4,212,908 | 7/1980 | Hendy et al. | 427/355 |

FOREIGN PATENT DOCUMENTS

| | | | |
|---|---|---|---|
| 2617767 | 11/1976 | Fed. Rep. of Germany | 118/404 |

*Primary Examiner*—John P. McIntosh

*Attorney, Agent, or Firm*—Richard H. Burgess

[57] ABSTRACT

An apparatus, process and distributor for providing thin, uniform coating of thixotropic materials on substrates, especially on cylinders. The distributor equally subdivides the coating composition from entry ports to a plurality of exit ports.

10 Claims, 4 Drawing Figures

THIXOTROPIC MATERIAL COATING APPARATUS, DISTRIBUTOR DEVICE AND METHOD

BACKGROUND

The present invention provides superior means for forming uniformly thin coatings on substrates such as cylinders. More particularly it provides a distributor device which permits obtaining such uniformity, along with a coating system which includes an apparatus and a method.

It is difficult to provide a thin coating of uniform thickness from a thixotropic material, and particularly difficult if the material is a plastisol such as polyvinyl fluoride in a latent solvent and if the substrate to be coated has a curved or cylindrical shape. Spray application tends to give an irregular or wavey orange peel texture. Dipping is not ideal because of the need for sheer forces to make thixotropic material flow. The use of thixotropic material rather than material with Newtonian viscosity behavior is important in avoiding sagging and curtaining of coatings.

For certain applications, close control of dielectric and other physical properties depend on uniformly thin coatings. While conventional coating techniques may lead to thickness variations of +/−10 or 15 to 20% with thixotropic materials, it is desireable to be able to obtain variations of +/−5%, 2½%, or even less.

Polyvinyl fluoride (PVF) is generally not soluble at room temperature in conventional solvents, however, it can be put into solution with so called latent solvents. A dispersion of PVF powder is suspended in latent solvent and heated to a first temperature at which a gel is formed and then to a higher second temperature at which a solution is formed. Latent solvents and other technology useful in handling PVF are discussed in U.S. Pat. Nos. 2,953,818—Bartron (Sept. 27, 1980) and 3,139,470—Prengle et al. (June 30, 1964), both incorporated herein by reference.

Technology for applying coatings to cylindrical surfaces, including plastisols such as polyvinyl chloride (PVC) in latent solvents, and other plastic coatings is described in U.S. Pat. Nos.:

2,647,296—Shive (Aug. 4, 1953),
2,647,488—Shive (Aug. 4, 1953),
3,690,294—Harper (Sept. 12, 1972),
3,896,764—Kindl, et al. (July 29, 1975), and
4,212,908—Hendy et al. (July 15, 1980), as well as U.S.S.R. Pat. No.
910,444—as U.S.S.R. Urals (Mar. 3, 1982).

The two Shive patents involve simply passing a wire through a bath of coating material and wiping the coated wire on its exit from the bath. Harper has a distributor head revolving around the substrate to be coated with interior paddles which aid in distributing the coating onto the substrate. The Soviet patent has a series of ports arranged longitudinally along the cylindrical substrate or pipe to give constant pressure along the length of the pipe.

Techniques of the prior art are not capable of giving results as good as desired for certain applications.

SUMMARY OF THE INVENTION

The invention provides a distributor device for delivery of coatings of relatively uniform thickness of thixotropic coating composition to a substrate, said device comprising at least one inlet port, a series of interconnected channels for dividing the flow of said coating composition, and at least 16 outlet ports for each inlet port, configured so that the length and cross section of the channels from each inlet port to each outlet port provide about the same resistance to the flow of coating composition, thereby permitting the delivery of about equal flow rates of coating composition from each outlet port.

Preferably, the device has an entry port which feeds a first arcuate channel which extends from the inlet port in opposite directions arcuately about 90° in each direction to two first branching points.

from said first branching points, connecting channels extend inwardly to two second arcuate channels, said second arcuate channels extend arcuately about 45° in each direction to four second branching points, from said second branching points, connecting channels extend inwardly to four third arcuate channels, said third arcuate channels extend arcuately about 22½° in each direction to eight third branching points, from said third branching points, connecting channels extend inwardly to eight fourth arcuate channels said fourth arcuate channels extend arcuately about 11¼° in each direction to sixteen fourth branching points, said arcuate channels being about concentric with a common axis, and said arcuate channels and connecting channels being recessed in said planar face, and a lid being secured over said planar face to seal said channels.

Processes for coating with such devices, and apparatus including such devices are also aspects of the invention.

DETAILED DESCRIPTION

In order to obtain more uniform pressure and flow rate of thixotropic material, such as PVF in latent solvent, a distributor device of the invention is used in an appropriate apparatus. The distributor device can be molded or machined into one face or two opposite faces of a circular disk of a suitable material such as aluminum or a plastic such as "Delrin" acetal plastic produced by the Du Pont Company.

Figure 1:
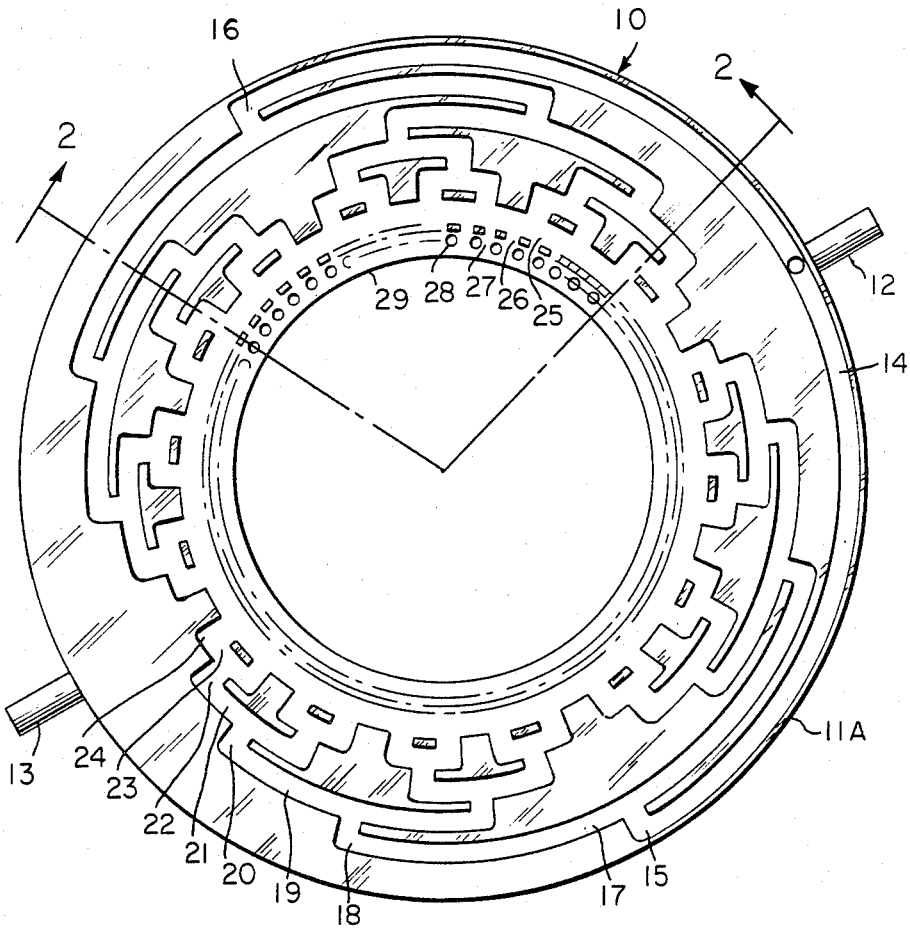
FIG. 1 is a plan view of a distributor device of the invention.
Figure 2:
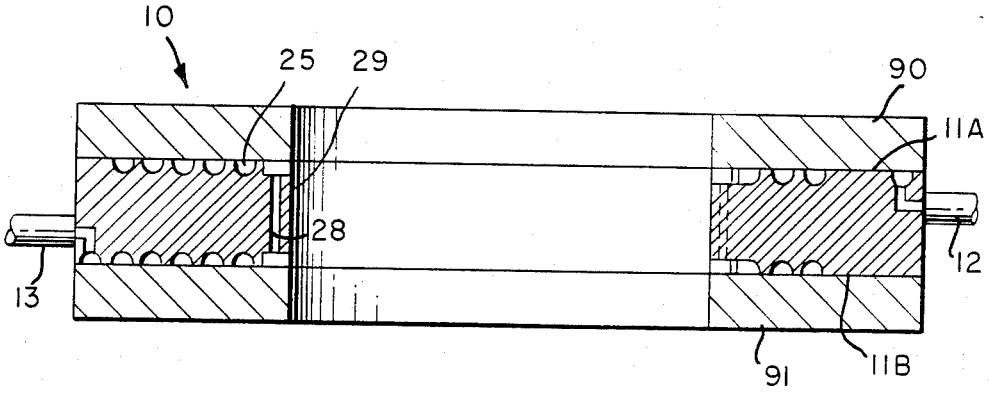
FIG. 2 is a vertical cross section of FIG. 1 taken along cutting plane 2—2.

Distributor 10 is illustrated in FIGS. 1 and 2. FIG. 1 is a plan view of top face 11 with the cover removed to show arcuate channels represented by 14, 17, 19, 21, 23 and 25 interconnected by inwardly extending connecting channels 15, 16, 18, 20, 22 and 24. Innermost arcuate channel 25 in the embodiment illustrated is in the form of a complete circle. Coating composition is supplied through inlet port 12 to first arcuate channel 14 which extends in opposite directions about 90° each way to distribution points at each end where connecting channels 15 and 16 extend inwardly to second arcuate channel 17 and its counterpart. For ease of understanding, only one set of each order of arcuate channels and connecting channels are numbered on FIG. 1. It will be readily apparent to those skilled in the art from studying the drawings that the numbered respective arcuate and connecting channels are representative of the channels over the entire top face llA of distributor 10.

Exit ports 26 deliver coating composition to inner circumferential shelf 27 where it is available to coat onto the outer surface of a cylindrical work object (not shown in FIG. 1) being moved through opening 29. Exit ports 26 are illustrated only for part of the circumference, but it will be understood that they actually extend all the way around.

Preferably, planar disk 11, the arcuate channels 14, 17, 19, 21, 23 and 25, opening 29 and the outer surface of the work object are all concentric with a common axis. However, the principles of the invention can be applied to coating of curvilinear surfaces other than circular and even flat surfaces or surfaces having other complex configurations, so long as the distributor device outlet exits can be maintained at about the same distance from the work moved past or through the distributor.

FIG. 2 illustrates, in offset cross section through plane 2—2 shown on FIG. 1, distributor device 10 with covers 90 and 91 in place to seal the channels in top and bottom faces llA and llB of distributor 10 so that coating composition can be fed into inlet port 12 to the channels in top face llA and through inlet port 13 to the channels in bottom face llB. While a two-faced distributor is not necessary and a single face can provide many of the advantages of the invention, use of a second face permits doubling the number of outlet ports without having to change the subdivision ratio (number of outlet ports per inlet port).

In the embodiment illustrated, the coating composition from bottom face llB rises through holes 28 which preferably alternate with exit ports 26 so that about 100% of the inner circumference is fed by coating composition, half from holes 28 and half from exit ports 26. Again, holes 28, like exit ports 26, are only illustrated in FIG. 1 for part of the circumference.

Figure 3:
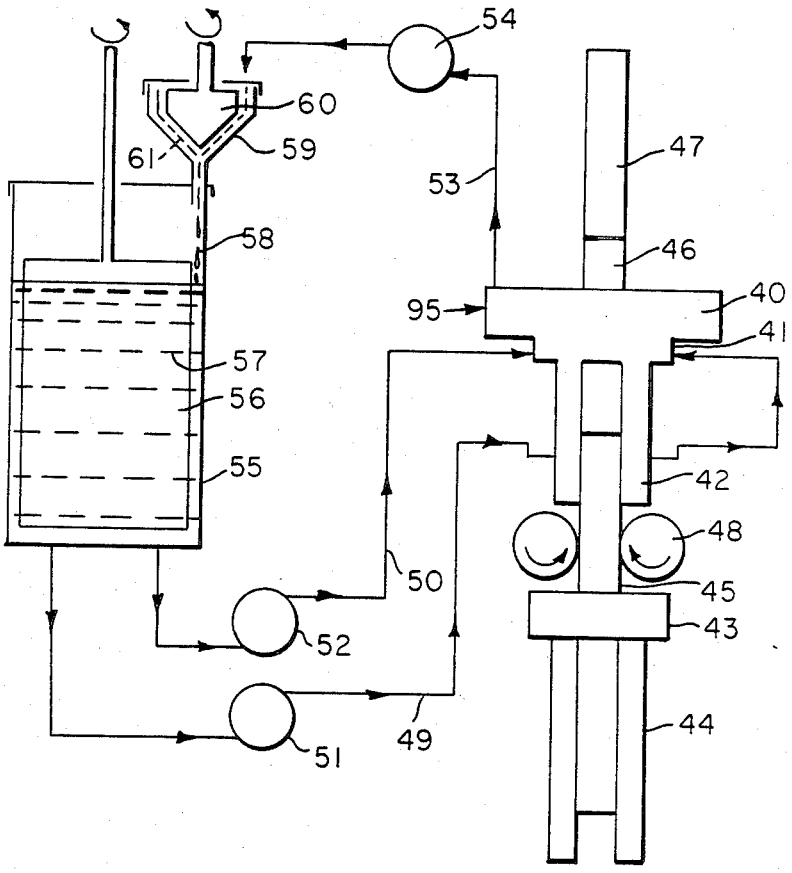
FIG. 3 is an overall schematic layout of an apparatus of the invention for coating cylindrical sleeves, using the distributor of FIGS. 1 and 2.

The general layout of an apparatus for using distributor 10 is schematically illustrated in FIG. 3. Coating station 95 comprises overflow head 40, distributor holder 41 and upper guide 42. Cylindrical work objects 45, 46, 47, are fed in through lower guide 44 and urged upward by roll feeding mechanism 48 into upper guide 42 and the rest of coating station 95.

Distributor holder 41 is provided on each side with coating composition through pipes 49 and 50 fed by suitable pumps 51 and 52 which can be peristaltic pumps with surge dampeners or can be constant pressure puCmps. Enough pressure is provided to deliver the coating composition through the distributor at the desired rate, such as 800 cc/min. Coating composition 57 is fed to pumps 51 and 52 from de-areator tank 55 where paddle 56 turns at a slow constant speed such as 1–3 revolutions per second to effectively dispose of air bubbles in coating composition 57. The coating composition itself can be provided to de-areator tank 55 from viscosity reducing tank 59 where paddle 60 rotates at a similar constant slow speed to produce an appropriate viscosity in coating composition 58 which then drops into de-areator tank 55. Since these coating composition materials are thixotropic, the shear/viscosity relationship can be adjusted as desired by changing the paddle speed and the speed with which the coating composition is supplied through the distributor. Overflow coating composition from overflow head 40 can is provided via pipe 53 and coating recirculation pump 54 back to viscosity reducing tank 59 through filter 61.

Figure 4:
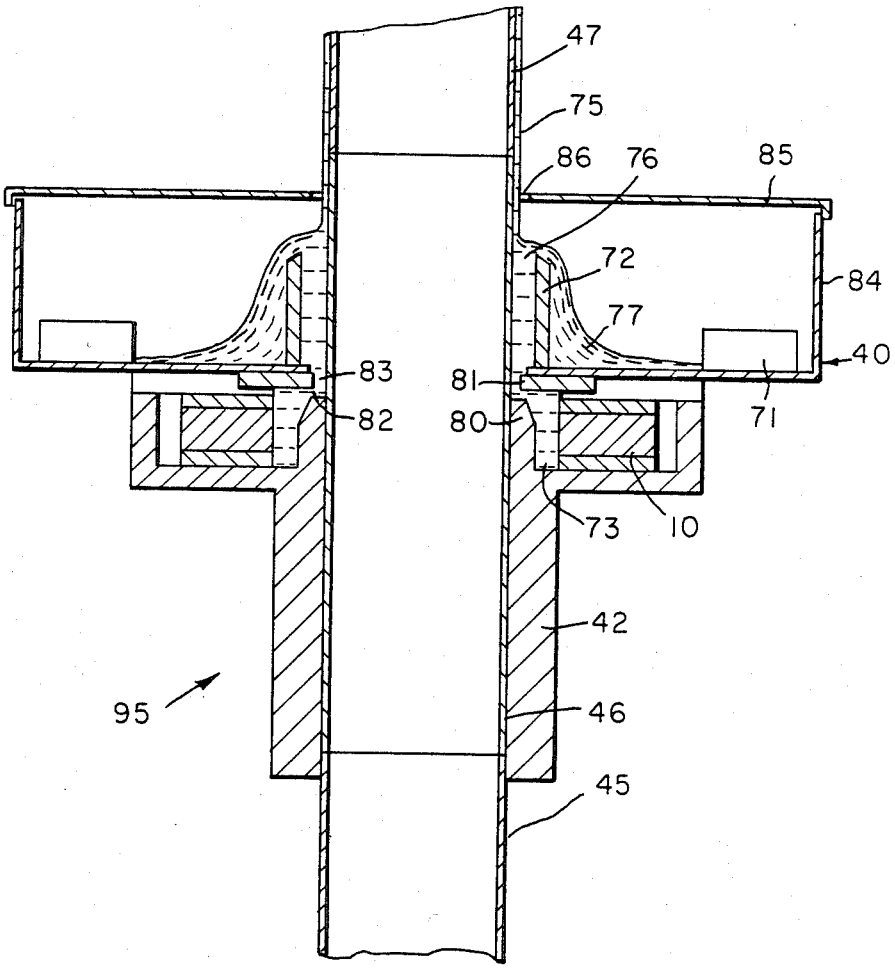
FIG. 4 is a schematic vertical cross section of the coating head of the apparatus of FIG. 3, showing the placement of the distributor of FIGS. 1 and 2.

FIG. 4 illustrates the configuration of the coating station. As cylindrical work object 45, 46 and 47 rise through upper guide 42 and past distributor 10, coating composition is provided at 73 with a relatively quite constant pressure circumferentially around work object 46. Upper guide 42 suitably has lip 80 and doctor blade 81 so configured as to provide annular opening 82 directed inwardly and annular opening 83 directed longitudinally along work object 46. For a work object having an outer diameter of 6.5 cm, moving vertically at 2.5 cm/sec, with coating composition supplied at 800 cc/min., suitable clearances are about 250 μm for opening 82 and 500 μm for opening 83 to work object 46.

The coating composition expands or wells up at 74 behind and over wier or bath retaining cylinder 72, such as 5 cm high, while the coating composition begins to congeal or solidify on work object 46. Excess coating composition at 76 overflows wier 72 into overflow head 40 which comprises trough 84 and lid 85 having a central opening 86 which permits work object 46 to exit overflow head 40. Suction ring 71 permits collection of overflow coating composition to be delivered via pipe 53 to pump 54 shown in FIG. 3 Congealed coating 75 typically has a wet thickness of 1000–1500 μm and a dried film thickness of 300 um. Work objects 46 and 47 have a continuous layer of coating 75, and can be separated manually or otherwise.

EXAMPLE

The process, apparatus and distributor of the invention are operated as described above using a coating composition, by weight of

| | |
|---|---|
| polyvinyl fluoride powder | 45 |
| propylene carbonate | 55 |
| Total | 100 |

The composition is sand ground using conventional techniques to a particle size which gives a Brookfield viscosity of number 4 spindle at 10 revolutions per minute, equivalent to 11,000 to 13,000 centiposes. This gives a dry film thickness of 300–325 μm. Longer grinding gives higher viscosity. Operating at a viscosity of 6,000 centipoises, dry film thicknesses of about 200 um are obtained. Appropriate thixotropy for coating PVF onto 6.5 cm diameter metal cylinders with a coating thickness variation in the range of +/−5% can be obtained with viscosities above about 2,500 centipoises.

Whichever of these materials are used, after coating according to the invention, the coated work objects are preferably cured at 205°–230° C. first for 5 minutes under coalescing conditions in a solvent rich atmosphere, then for 25 minutes with air circulation, preferably in the higher part of the specified temperature range.

I claim:

1. A distributor device for delivering a relatively uniform thickness of thixotropic coating composition to a curved surface of a substrate, wherein the device is concentric with and surrounds a cylindrical opening into which is to be inserted the substrate to be coated, said device comprising at least one inlet port, a series of interconnected arcuate channels for dividing the flow of said coating composition, and at least 16 outlet ports for each inlet port, configured so that the length and cross section of the channels from each inlet port to each outlet port provide above the same resistance to the flow of coating composition, wherein the channels are of about the same cross section, and the channels subdivide a number of times at branching points, with about the same length of channel going in each of two opposite directions from each branching point, thereby permitting the delivery of about equal flow rates of coating composition from each outlet port, wherein said arcuate channels and branching points are recessed in a first face of a circular disk having a concentric opening in the middle to form an inner circumference and the second face opposite to said first face of said disk has a mirror image of said arcuate channels and branching points with a second inlet port about 180° opposite said first inlet port and with the branching points on each face alternating around the inner circumference to form outlet ports, the size of such outlet ports being such that about 50% of the inner circumference is open for the delivery of coating on the first face, and the other 50% is open on the second face.

2. The device of claim 1 having a planar face, said device having an inlet port which feeds a first arcuate channel which extends from the inlet port in opposite directions arcuately about 90 in each direction to two first branching points, from said first branching points, connecting channels extend inwardly to two second arcuate channels said second arcuate channels extend arcuately about 45° in each direction to four second branching points, from said second branching points, connecting channels extend inwardly to four third arcuate channels, said third arcuate channels extend arcuately about $22\frac{1}{2}°$ in each direction to eight third branching points, from said third branching points, connecting channels extend inwardly to eight fourth arcuate channels said fourth arcuate channels extend arcuately about $11\frac{1}{4}°$ in each direction to sixteen fourth branching points, said arcuate channels being about concentric with a common axis, and said arcuate channels and connecting channels being recessed in said planar face, and a lid being secured over said planar face to seal said channels.

3. The device of claim 2 wherein the fourth branching points are outlet ports adapted to deliver coating composition to a cylindrical substrate concentric with said common axis.

4. The device of claim 2 wherein from the fourth branching points connecting channels extend inwardly to sixteen fifth arcuate channels, and said fifth arcuate channels extend arcuately about $5\frac{5}{8}°$ in each direction to thirty two fifth branching points.

5. The device of claim 4 wherein from the fifth branching points connecting channels extend inwardly to a sixth arcuate channel which is in the form of a continuous circle, and said sixth arcuate channel communicates with sixty four fifth branching points.

6. The device of claim 1 wherein the outlet ports on said second face are connected to said first face by individual holes, one for each outlet port, adapted to deliver all the coating composition to the substrate to be coated at said inner circumference.

7. A method of coating a substrate with a relatively uniform thickness of thixotropic coating composition by providing such coating composition under pressure to the inlet ports of the device of claim 1, so that the coating composition is delivered at a uniform rate and pressure to each outlet port, wherein the substrate to be coated moves past the outlet ports at a constant velocity.

8. The process of claim 7 wherein the coating composition, after delivery to the substrate by said device is permitted to expand, and the excess is permitted to flow off the substrate over a wier.

9. The method of claim 7 wherein the coating composition is a plastisol of polyvinyl fluoride in latent solvent.

10. An apparatus for coating cylindrical substrates by a process of claim 7 adapted to move said substrates serially into and through said device, and with means provided to give a continuous supply of coating composition to said device, and to recirculate excess coating composition.

* * * * *